United States Patent [19]

Uhlir et al.

[11] Patent Number: 4,793,160

[45] Date of Patent: Dec. 27, 1988

[54] DEVICE FOR CONTROLLING THREAD GUIDES OF CIRCULAR KNITTING MACHINES

[75] Inventors: Pavel Uhlir; Jaroslav Maxa, both of Trebic, Czechoslovakia

[73] Assignee: ELITEX koncern textilniho strojirenstvi, Liberec, Czechoslovakia

[21] Appl. No.: 415,687

[22] Filed: Sep. 7, 1982

[30] Foreign Application Priority Data

Sep. 7, 1981 [CS] Czechoslovakia ..... 6584-81

[51] Int. Cl.[4] ..... D04B 15/74; D04B 15/58

[52] U.S. Cl. ..... 66/224; 66/138; 66/240

[58] Field of Search ..... 66/43, 133, 138, 139, 66/140 R, 224, 225, 226, 227, 240

[56] References Cited

U.S. PATENT DOCUMENTS

| | | | |
|---|---|---|---|
| 705,203 | 7/1902 | Buoker | 66/240 X |
| 2,075,077 | 3/1937 | Aaronson | 66/224 X |
| 2,625,808 | 1/1953 | Green et al. | 66/138 |
| 2,709,351 | 5/1955 | Bouthillette et al. | 66/138 |
| 3,013,415 | 12/1961 | Auton | 66/43 |

FOREIGN PATENT DOCUMENTS

| | | | |
|---|---|---|---|
| 655471 | 7/1963 | Italy | 66/225 |
| 8386 | of 1911 | United Kingdom | 66/138 |
| 20548 | of 1913 | United Kingdom | 66/138 |

*Primary Examiner*—W. C. Reynolds

*Attorney, Agent, or Firm*—Klein & Vibber

[57] ABSTRACT

Device for controlling the thread guides in a circular knitting machine, particularly for manufacturing hosiery and similar goods. The machine has a grooved needle cylinder, the grooves containing needles and needle jacks. The machine also has a control drum which controls the needle jacks by selectively tipping them by control elements mounted upon the cylindrical surface of a control drum. The thread guides of the knitting machine are controlled by programming elements mounted on an outer end surface of the control drum, the thread guides being selectively driven by programming elements mounted upon the outer end surface of the control drum.

2 Claims, 2 Drawing Sheets

DEVICE FOR CONTROLLING THREAD GUIDES OF CIRCULAR KNITTING MACHINES

The present invention relates to a device for controlling thread guides in circular knitting machines, particularly circular knitting machines for manufacturing hosiery and similar goods. Said device comprises a control drum, the axis of which is parallel to the axis of the needle cylinder axis, and on the cylindrical surface of which there are provided programming elements for the purpose of controlling operative machine elements in the radial direction.

Small diameter circular knitting machines for manufacturing hosiery and similar goods are known, in which the thread guides are mounted in the separate feeds and are controlled from the circumference of the main control drum, or from the circumference of an indepenent control drum.

The disadvantages of this arrangement consist, above all, in the complexity of the transmission from the control drum to the separate guides; this also requires much built-up space, and restricts the application of a plurality of guides in the separate feeds.

The present invention aims to mitigate the above disadvantages in a simple manner, this being characterized by the fact that on the front surface of the control drum there are provided programming elements, to which means for controlling the thread guides are attached.

The device according to the present invention is shown in the form of a preferred example in the accompanying drawings, of which:

Figure 2:
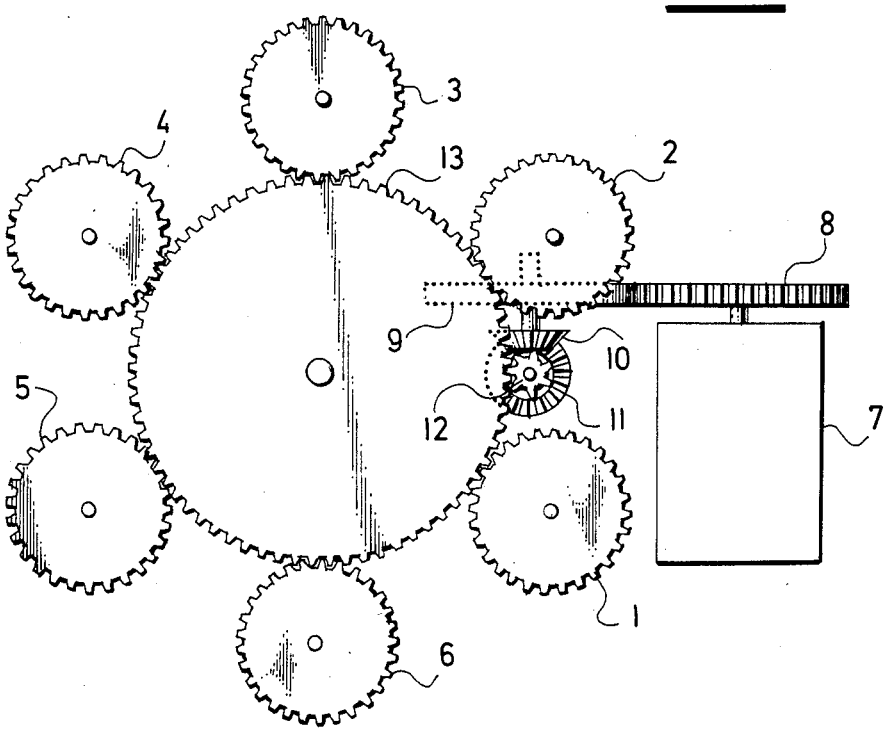
FIG. 2 is a diagrammatic representation of the drive of separate drum.

A known cylinder knitting machine for manufacturing hosiery and similar goods is provided with control drums in the separate feeds, which are arranged around the needle cylinder, and the axes of rotation thereof are parallel to the needle cylinder axis. The motion of the separate control drums is performed from gears 1 to 6 (FIG. 2), and is derived from a main control drum 7, to which a gear 8 is attached, which is in mesh with gear 9, to which a bevel gear 10 is fixedly attached. Said bevel gear 10 is in engagement with a bevel gear 11, which is fixedly mounted on a common shaft on which a gear 12 is fixedly mounted. Gear 12 meshes with a central gear 13, which in turn meshes with the above-mentioned gears 1 to 6.

For the purpose of explaining the present invention, the mounting of one control drum is described, said one control drum being arranged in the same manner as all the mountings of the other control drums.

Figure 1:
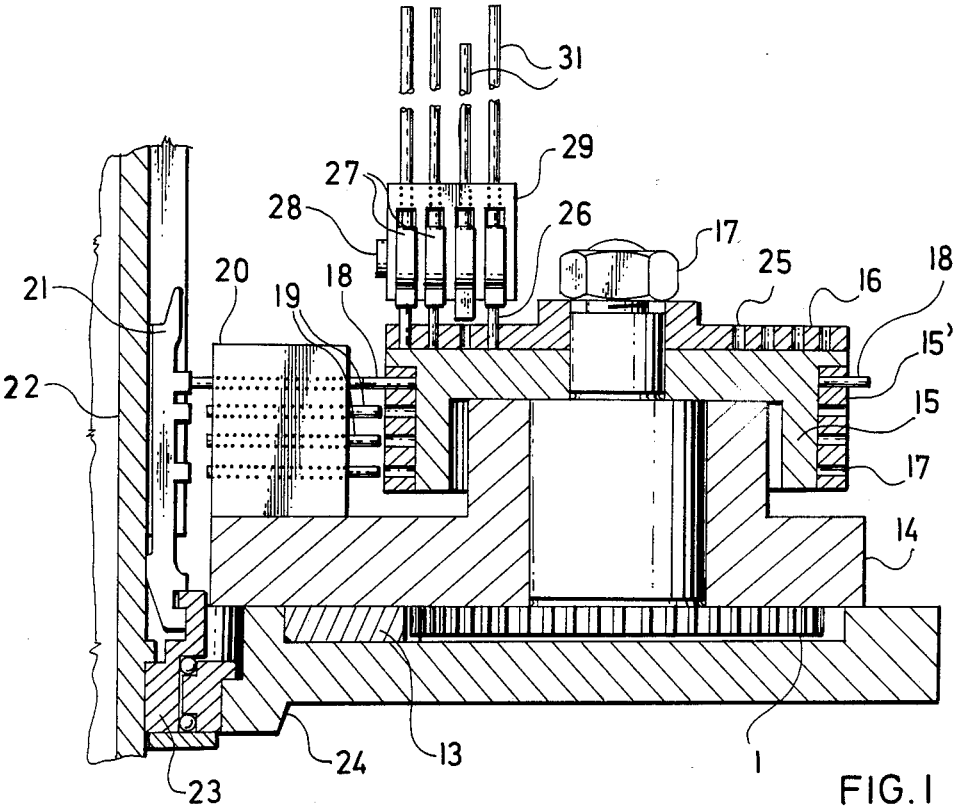
FIG. 1 is a framentary view in section through the control drum attached to the needle cylinder.

On gear 1, which is rotatably mounted in the feed body 14 (FIG. 1), there are a cylindrical rotatably drum body 15, and a disc 16 which is mounted upon the upper end surface of the cylindrical drum body 15, such end surface being disposed in a plane transverse to the central axis of the drum 15. A fixed connection of drum body 15 and disc 16 with gear 1 is secured by nut 17'. An annular drum 15' is pressed on drum body, drum 15' being provided with openings 17, in which there are pressed pins 18, or other programming elements, e.g. segments or the like, according to the knitting program.

Pins 18 act upon selecting levers 19 or other operative elements, which are movable mounted in the lever body 20, which is firmly attached on the feed body 14. The selecting levers 19 act upon jacks 21, which are swingably mounted within the grooves of needle cylinder 22. The needle cylinder 22 is rotatably mounted by means of bearing 23 in the machine frame 24. In this machine frame 24, the rotatable central gear 13 and the stationary feed body 14 are also mounted.

Figure 3:
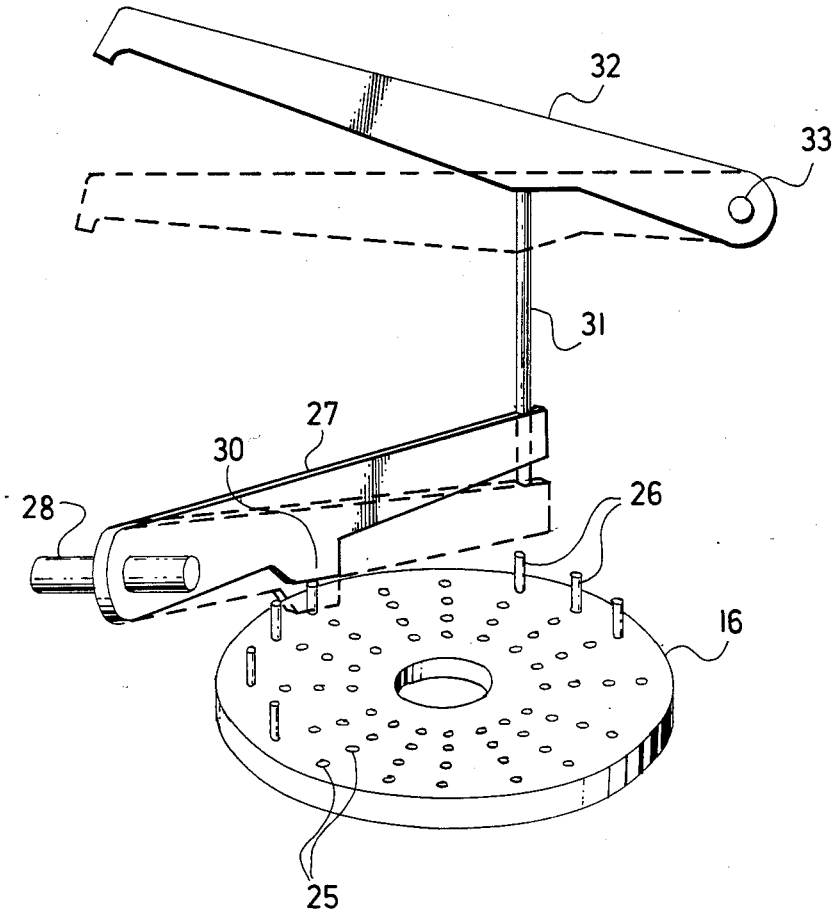
FIG. 3 is an axonometric projection of the device for controlling the thread guides.

Disc 16 is provided with openings 25 for pins or other programming elements, e.g. segments, which are arranged in that manner on the front part of the control drum formed by cylindrical body 15, drum 15' and disc 16. The pins 26 control first levers 27 which are mounted rotatably on a pin 28. Pin 28 is pressed into a slotted body 29 which receives one end of each of the levers 27 of the body 29 being fixed to the body 14 of the feed. The first, guide levers 27 are provided with run-on parts 30 which engage pins 26 and act upon second thread guide levers 32 (FIG. 3) through the intermediary of lifting rods 31. The thread guide levers 32 are mounted on a pin 33 which is attached to the machine frame.

The device as described above operates as follows: Upon rotating control drum 7, all drums are rotated simultaneously, i.e. also drum 15' and disc 16. The pins 18 control the jacks 21 by means of selecting levers 19. Disc 16, which is rotated at the same time, acts with its pins 26 upon levers 27 of thread guides 32 according to a predetermined program. Upon attaining the position below run-on part 30 of lever 27 by pin 26, the thread guide 32 is lifted by lifting rod 31 into its inoperative position, which is shown in full lines in FIG. 3. When run-on part 30 drops down from pin 26, thread guide 32 is turned into its operative position, shown in FIG. 3 in dash lines; the lifting rod 31 and lever 27 descend at the same time.

Within the scope of the present invention, modification in the actual embodiment of the control drum formed by cylindrical body 15, drum 15' and disc 16 are possible according to the type of programming elements to be employed. Furthermore, the means for controlling thread guides from pins, or programming elements, respectively, may be made in the form of a mere lever transmission or the like.

The main advantage of the present invention is that the device reduces the space requirements for the built-up area, and simultaneously accomplishes the control of the thread guides and the drive of the drum in a simple manner.

Although the invention is illustrated and described with reference to one preferred embodiment thereof, it is to be expressly understood that it is in no way limited to the disclosure of such preferred embodiment but is capable of numerous modifications within the scope of the appended claims.

We claim:

1. A device for controlling thread guide levers in a circular knitting machine having a needle cylinder having a plurality of grooves with needle control jacks therewithin, comprising a control drum disposed with its axis parallel to the axis of the needle cylinder, first programming elements mounted upon the cylindrical surface of the control drum for controlling the needle control jacks of the knitting machine by moving them in a radial direction, second programming elements mounted upon an end surface of the control drum disposed in a plane transverse to the axis thereof, and means operated by the second programming elements for controlling the thread guide levers of the knitting machine;

wherein the second programming elements are in the form of programming pins mounted in openings on a disc mounted on said transverse end of the control drum and fixedly secured thereto, the first programming elements being in the form of radially disposed pins on the cylindrical surface of the body of the control drum;

wherein the means for controlling the thread guide levers comprises first levers having run-on parts which cooperate with the programming pins mounted in the openings of the disc, and lifting rods bearing against the ends of said levers for controlling the thread guide levers.

2. A device as claimed in claim 1, wherein the thread guide lever are mounted upon a first end of each of a group of second levers, and said lifting rods are disposed between said first named levers and said second levers.

* * * * *